US006488035B2

(12) United States Patent
Sorsi

(10) Patent No.: US 6,488,035 B2
(45) Date of Patent: Dec. 3, 2002

(54) COIL-SPRING HAIR ORNAMENT HAVING DECORATIVE CHAIN

(75) Inventor: Silvana Sorsi, Vicenza (IT)

(73) Assignee: Balestra 1882 S.p.A., Vicenza (IT)

( * ) Notice: Subject to any disclaimer, the term of this patent is extended or adjusted under 35 U.S.C. 154(b) by 0 days.

(21) Appl. No.: 09/864,842

(22) Filed: May 24, 2001

(65) Prior Publication Data

US 2001/0047809 A1 Dec. 6, 2001

(30) Foreign Application Priority Data

May 29, 2000 (IT) ..... V12000A000113
Jun. 12, 2000 (IT) ..... V12000A000129

(51) Int. Cl.[7] ..... A45D 8/00
(52) U.S. Cl. ..... 132/275
(58) Field of Search ..... 132/273, 275, 132/276, 277, 278, 279, 280, 281, 282, 283, 284; 63/14.2, 23, 13; D28/39, 40, 41, 42, 43; 16/78; 24/116, 3.6, 3.13, 3.12

(56) References Cited

U.S. PATENT DOCUMENTS

| | | | | | |
|---|---|---|---|---|---|
| 1,725,125 | A | * | 8/1929 | Bartley | 132/273 |
| 2,209,475 | A | * | 7/1940 | Rawlings | 24/598.6 |
| 3,163,026 | A | * | 12/1964 | Kenny | 63/14.2 |
| 4,406,296 | A | * | 9/1983 | Wexler et al. | 132/148 |
| D317,663 | S | * | 6/1991 | Calderon | D28/41 |
| 5,634,479 | A | * | 6/1997 | Jordan et al. | 132/275 |
| 5,778,904 | A | * | 7/1998 | Elsner | 132/275 |
| 6,003,521 | A | * | 12/1999 | Huang | 132/275 |
| D434,527 | S | * | 11/2000 | Gerow | D28/42 |
| 6,164,292 | A | * | 12/2000 | Di Maria Poole et al. | 132/275 |
| 6,305,386 | B1 | * | 10/2001 | Wochadlo | 132/275 |
| 2001/0054299 | A1 | * | 12/2001 | White | 63/23 |

* cited by examiner

*Primary Examiner*—Nicholas D. Lucchesi
*Assistant Examiner*—David Comstock
(74) *Attorney, Agent, or Firm*—Bucknam and Archer

(57) ABSTRACT

An ornamental coil-spring element is applied to a lock of hair of the user which engages with the lock of hair and one or more chains (1) hang from the spring element to confer a pleasant aesthetic effect to the hair of the user.

5 Claims, 2 Drawing Sheets

COIL-SPRING HAIR ORNAMENT HAVING DECORATIVE CHAIN

FIELD OF THE INVENTION

The present invention relates to an ornamental element to be applied to a lock of the hair of the user.

BACKGROUND OF THE PRIOR ART

It is known that since time immemorial people, particularly of female sex, have worn ornamental elements such as bracelets, necklaces, pins, earrings, pendants and similar articles.

Frequently ornamental articles to be arranged on the hair of the user have been used. By way of example there is mentioned the application of flowers, small beads and other decorative elements to the hair, a typical application among primitive people.

Actually the decoration of the hair of the user is not carried out in general with special devices but by utilizing hairpins, small combs and similar articles which, in addition to collecting in some manner the hair of the user, are shaped in a particular manner so as to guarantee a certain aesthetic effect.

In addition, particularly in the more recent years, the utilization of dyeing with coloring materials so as to give particular color to the hair has spread among women and to a lesser extent among men.

However, actual jewelry articles and articles of non-precious metals such as chains, pins and similar articles, are not applied to the hair of the user because of the difficulty of making sure that these objects remain in the hair in a stable manner.

SUMMARY OF THE INVENTION

The object of the present invention is to provide an ornamental element which remains continuously on or in the hair of the user and which is simple from the constructive point of view and easy to apply to the hair of the user.

This object is achieved according to the invention by providing an element which has elastic means so that it may grasp a lock of hair of the user and at least a chain for decoration purpose hangs from the elastic means. In this manner the user has available a decorative element which may potentially acquire a great variety of aesthetic appearances in relation to the particular conformation of both the chain or chains present and the elastic means which grasp the hair.

BRIEF DESCRIPTION OF THE DRAWINGS

These and other features of the invention are described in detail by reference to two particular embodiments provided herein as non-limiting examples, by reference to the drawings of which.

DETAILED DESCRIPTION OF THE INVENTION

Figure 1:
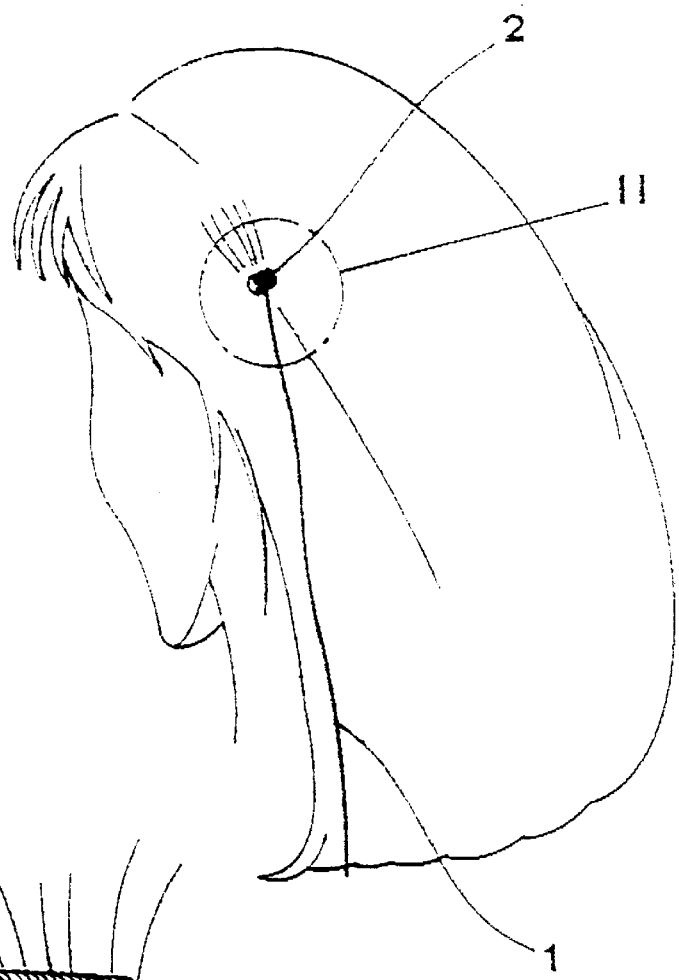
FIG. 1 shows a schematic view of the first embodiment of the invention.

FIG. 1 shows that according to the first embodiment of the invention, there are provided means capable of engaging a lock of hair of the user. The main feature of the device is constituted by the fact that at least a chain (1) hangs from the means which engage with the lock of hair and the chain gives a particular aesthetic effect to the hair of the user.

Figure 2:
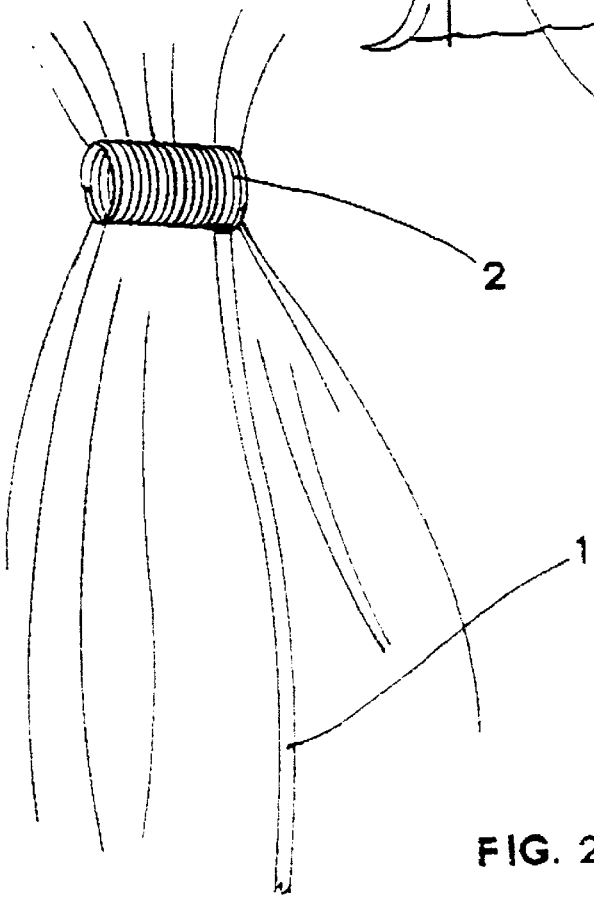
FIG. 2 shows a more detailed view of the first embodiment of the invention.

FIG. 2 shows that advantageously the means capable of engaging with a lock of hair of the user are constituted by a spiral spring (2), which may be shaped in a variety of ways, since the coils could be circular, square, oval, etc. Also the diameter of the coils may vary along the spring, thus giving rise to particular aesthetic effects. At the end of the spring terminal elements having a decorative effect may also be provided.

The chain may be of any type and may have, at the intermediate portion or at its extremities, one or more decorative elements, such as precious, semi-precious, or non-precious stones or other decorative elements, such as small hearts, small stars, etc.

Both the spring and the chain may be of any material, precious or non-precious. In addition both the spring and the chain may have particular colors, for aesthetic purpose.

It should be kept in mind that the spring may be replaced by any other element capable of grasping in a sufficiently stable manner a lock of hair of the user. By way of a non-limiting example, the function of the spring may be carried out by a hairpin, a clamp or similar articles.

Figure 3:
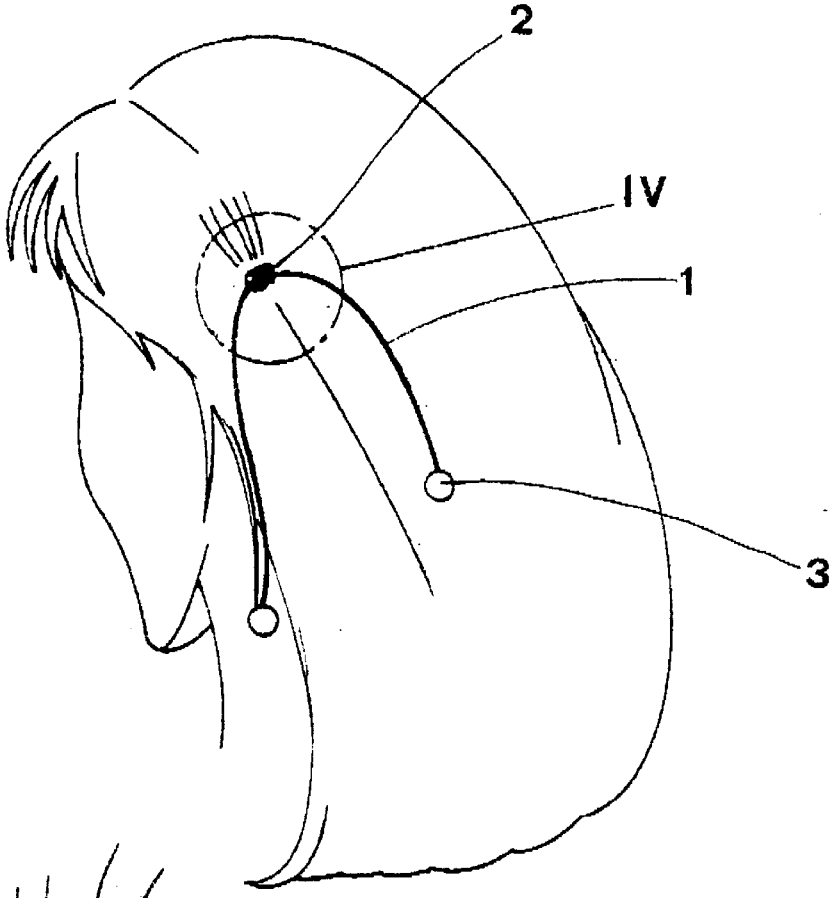
FIG. 3 is a schematic view of the second embodiment of the invention.
Figure 4:
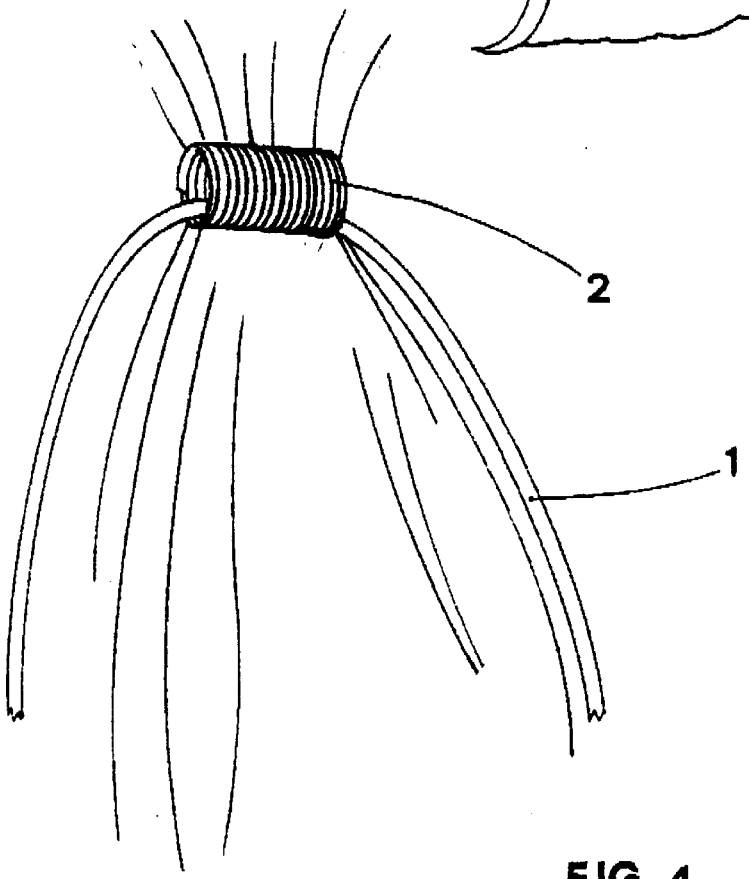
FIG. 4 is an enlarged view of the second embodiment of the invention.

FIG. 3 shows that the second embodiment of the invention comprises a spiral spring (2), capable of engaging with a lock of hair, and chain (1) inserted in the spring, with the extremities of the chain hanging down from the extremities of the spring.

Two terminals (3) are present corresponding to each of the two extremities of the chain. The terminals in the figure have the shape of small spheres but they could have different shapes, as long as they are capable of occupying totally the transversal section of the spring in a manner that they cannot be inserted within the spring.

The presence of the chain confers a particular aesthetic effect to the hair of the user.

Also in this case the observation already made with respect to the particular conformation of the spiral spring, the diameter of the coils, and the particular conformation of the chains are applicable.

With respect to the utilization of this particular form of accomplishment of the device, the user must position the chain in the desired manner with respect to the spiral spring, in such a way that the extremities of the chain are let out from the spiral spring in the quantity desired, after which the user will hook the spiral spring to a lock of hair.

It is emphasized that all the objects which conceptually contain the features discussed hereinabove are included in the present invention, with the exception of their particular conformation and configuration.

On the basis of what has been shown hereinabove, it is clear that by utilizing the device according to the present invention the user may obtain a valid decorative element which is simple from both the constructive and functional point of view and which in addition is intrinsically light so that the embodiments are intrinsically economical even if they are made of a precious metal and the decorative element in addition may be used easily.

What is claimed is:

1. An ornamental element to be applied to a lock of hair of the user, said ornamental element comprising:

a spiral spring adapted to grasp the lock of hair of the user, each spiral being urged against an adjacent spiral in a resting position, said spiral spring having two extremities;

a chain hanging down from said spiral spring for decorative purposes, said chain being inserted within said spiral spring and having two extremities, each chain extremity hanging from a respective extremity of said spiral spring; and a terminal element provided at each chain extremity and being of such a shape and dimension that it is free from insertion within said spiral spring.

2. The ornamental element as defined in claim 1, wherein said spiral spring has coils with modified dimensions along the longitudinal course of said spiral spring.

3. The ornamental element as defined in claim 1, wherein terminal elements are provided at the extremities of said spiral spring.

4. The ornamental element as defined in claim 1, wherein said chain includes auxiliary beautifying elements.

5. The ornamental element as defined in claim 1, which comprises a plurality of chains hanging from said spiral spring.

* * * * *